US005908288A

United States Patent [19]

Moran

[11] Patent Number: 5,908,288

[45] Date of Patent: Jun. 1, 1999

[54] FLUID COUPLER FOR A STACKED PUMP SYSTEM

[76] Inventor: Joseph F. Moran, 5200 Mill, Dryden, Mich. 48428

[21] Appl. No.: 09/078,889

[22] Filed: May 14, 1998

[51] Int. Cl.[6] ..... F04B 35/04

[52] U.S. Cl. ..... 417/423.5; 285/125.1; 166/105; 138/108; 138/111

[58] Field of Search ..... 285/125.1, 127.2, 285/129.1, 131.1; 417/423.5, 555.2, 904, 313, 423.3, 521, 572; 166/105; 138/108, 111

[56] References Cited

U.S. PATENT DOCUMENTS

| | | | |
|---|---|---|---|
| 2,605,612 | 8/1952 | Mason | 417/904 X |
| 5,088,771 | 2/1992 | Hosseman et al. | 285/39 |
| 5,090,737 | 2/1992 | Brammer et al. | 285/39 |
| 5,215,335 | 6/1993 | Hamm, Jr. | 283/39 |
| 5,219,186 | 6/1993 | Hosseinian et al. | 285/39 |
| 5,311,640 | 5/1994 | Holland | 417/423.5 X |

FOREIGN PATENT DOCUMENTS

| | | |
|---|---|---|
| 703724 | 12/1979 | U.S.S.R. . |
| 1770668 | 10/1992 | U.S.S.R. . |

*Primary Examiner*—Peter M. Cuomo
*Assistant Examiner*—Karlena D. Schwing
*Attorney, Agent, or Firm*—Henderson & Sturm

[57] ABSTRACT

A fluid coupling 10 for connecting the output of an upper 102 and a lower 101 submersible pump in a well casing 100 to the well supply pipe 105. The fluid coupler 10 includes an upper coupling unit 11 connected to the upper pump 102, a lower coupling unit 12 connected to the lower pump 101, and a manifold unit 13 operatively connecting the upper 11 and lower 12 units together to form a framework which surrounds and suspends the upper pump 102.

7 Claims, 1 Drawing Sheet

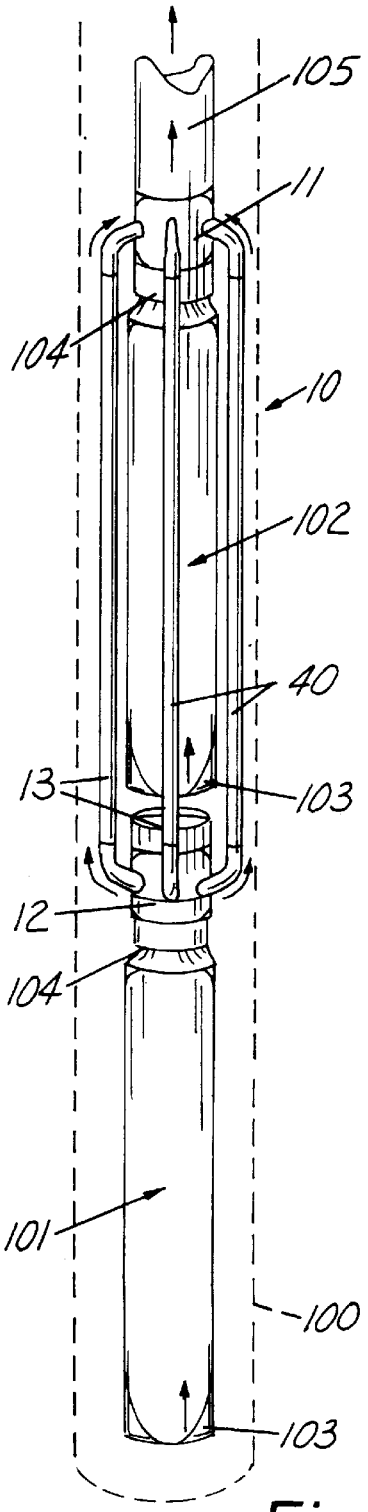
Fig. 1
Fig. 2
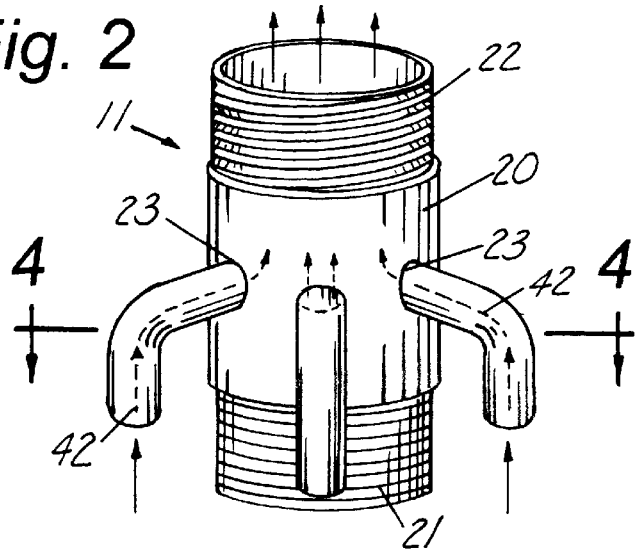
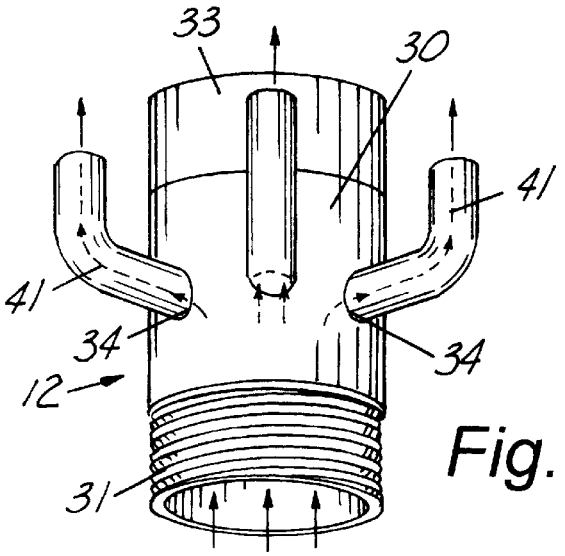
Fig. 3
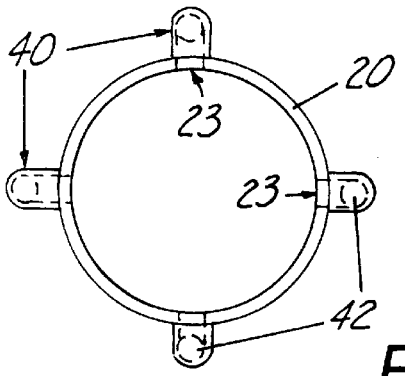
Fig. 4

FLUID COUPLER FOR A STACKED PUMP SYSTEM

BACKGROUND OF THE INVENTION

1. Field of the Invention

The present invention relates to the field of fluid couplers in general, and in particular to a fluid coupler for a stacked pump system.

2. Description of Related Art

As can be seen by reference to the following U.S. Pat. Nos. 5,088,771; 5,090,737; 5,215,335; and 5,219,186, the prior art is replete with myriad and diverse fluid coupling arrangements.

While all of the aforementioned prior art constructions are more than adequate for the basic purpose and function for which they have been specifically designed, they are uniformly deficient with respect to their failure to provide a simple, efficient, and practical fluid coupler that can be used to supplement the output of a first submerged pump with the output of a second submerged pump in a stacked pump arrangement disposed within a well casing such that the stacked pump array can deliver on demand, the output of the pumps alternately or in combination with one another contingent upon the volume of water required for a specific task.

As a consequence of the foregoing situation, there has existed a longstanding need for a new and improved fluid coupler for a stacked pump system to allow for the delivery of different volumes of water from a well, and the provision of such a construction is a stated objective of the present invention.

BRIEF SUMMARY OF THE INVENTION

Briefly stated, the fluid coupler that forms the basis of the present invention comprises an upper coupling unit, a lower coupling unit, and a manifold unit that operatively connects the upper coupling unit to the lower coupling unit.

As will be explained in greater detail further on in the specification, the environment in which the fluid coupler is employed involves a well casing having upper and lower submersible pumps arranged in a vertically stacked relationship. The output of the lower pump passes into the lower coupling unit, through the manifold unit and into the upper coupling unit. The output of the upper pump passes directly through the upper coupling unit which is directly connected to the well water supply pipe.

It is envisioned that the pumps will have different horsepower outputs such as ½HP and 1½HP such that during low demand periods, only the ½HP pump will deliver water to the well supply pipe; during higher demand periods only the 1½HP pump will be activated and during peak demand periods, both of the pumps will be activated to deliver water to the supply pipe via the fluid coupler.

As will also be appreciated by reading the specification, the fluid coupler not only suspends both of the pumps within the well casing, but also forms a framework which surrounds the upper pump.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the fluid coupler of this invention installed on stacked submersible pumps within a well casing;

FIG. 2 is an isolated detail view of the upper coupling unit;

FIG. 3 is an isolated detail view of the lower coupling unit; and

FIG. 4 is a cross sectional view taken through line 4—4 of FIG. 2.

DETAILED DESCRIPTION OF THE INVENTION

As can be seen by reference to the drawings, and in particularly to FIG. 1, the fluid coupler that forms the basis of the present invention is designated generally by the reference number 10. The fluid coupler 10 comprises in general an upper coupling unit 11, a lower coupling unit 12, and an intermediate manifold unit 13. These units will now be described in seriatim fashion.

Still referring to FIG. 1, it can be seen that the fluid coupler 10 is operatively connected to a pair of submersible pumps 101, 102 disposed in a stacked relationship within a well casing 100. Each of the pumps 101, 102 are provided with an inlet end 103 and an outlet end 104 wherein the fluid coupler 10 is operatively connected to the outlet end 104 of each of the stacked pumps 101, 102.

As can best be seen by reference to FIGS. 1 and 2, the upper coupling unit 11 comprises a hollow cylindrical upper collar member 20 having a lower threaded extension 21 which is dimensioned to threadedly engage the outlet end 104 of the upper submersible pump 102 and an upper threaded extension 22 that is dimensioned to engage the bottom of a well water supply shaft 105.

In addition, the upper collar member 20 is further provided with a plurality of fluid inlet apertures 23 at spaced locations around the periphery of the upper collar member 20. The purpose and function of the fluid inlet apertures 23 will be explained in greater detail further on in the specification.

As shown in FIGS. 1 and 3, the lower coupling unit 12 comprises a hollow cylindrical lower collar member 30 having a lower threaded extension 31 dimensioned to threadedly engage the outlet end 104 of the lower submersible pump 101 and an upper sealed cap element 33 which sealingly engages the upper end of the lower collar member 30.

In addition, the lower collar member 30 is also provided with a plurality of fluid outlet apertures 34 at spaced locations around the periphery of the lower collar member 30. The apertures 34 in the lower collar member 30 are aligned with the apertures in the upper collar member 20.

As can be seen by reference to FIGS. 1 through 4, the manifold unit 13 comprises a plurality of tubular pipe sections 40 having lower elbow connectors 41 formed on their lower ends which are operatively connected to the fluid outlet apertures 34 in the lower collar member 30 and having upper elbow connectors 42 formed on their upper ends which are operatively connected to the fluid inlet apertures 23 in the upper collar member 20.

In addition, as can best be appreciated by reference to FIG. 1, the upper 11 and lower 12 coupling units and the manifold unit 13 combine to form a framework that surrounds and suspends the upper submersible pump within the fluid coupler 10.

As was mentioned previously, the pumps 101 and 102 can be activated either independently or in combination with one another wherein the output of the lower pump 101 will be directed from the lower coupling unit 11 through the manifold unit 13 and into the upper coupling unit 11. The output of the upper pump 102 is delivered into the well supply pipe 105 directly through the upper coupling unit 11 in a well recognized fashion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A fluid coupler connecting the output of two submersible pumps into a well supply pipe wherein the pumps include a lower pump and an upper pump each having an outlet end wherein the fluid coupler comprises:

an upper coupling unit operatively connected to the outlet end of the upper submersible pump;

a lower coupling unit operatively connected to the outlet end of the lower submersible pump; and a manifold unit operatively connected between the upper and lower coupling units and forming a framework that surrounds the upper submersible pump.

2. The fluid coupler as in claim 1 wherein the upper and lower coupling units each include a collar member having a lower extension adapted to be connected to the outlet ends of one of the submersible pumps.

3. The fluid coupler as in claim 2 wherein each of the collar members are provided with a plurality of apertures.

4. The fluid coupler as in claim 3 wherein the plurality of apertures on each of the collar members are aligned with one another.

5. The fluid coupler as in claim 4 wherein the manifold unit includes a plurality of pipe sections wherein the plurality of pipe sections are operatively connected to the plurality of apertures in the upper and lower collar members.

6. The fluid coupler as in claim 2 wherein the collar member in the lower coupling unit is provided with a sealed cap element.

7. The fluid coupler as in claim 6 wherein the collar member in the upper coupling unit is provided with an upper extension adapted to be connected to the well water supply pipe.

* * * * *